169-45 SR
10/14/36 OR 4,616,711

United States Patent [19]

Johnson

[11] Patent Number: 4,616,711

[45] Date of Patent: Oct. 14, 1986

[54] SYSTEM AND METHOD OF CONTROLLING AND PREVENTING THE SPREAD OF FOREST FIRES

[76] Inventor: John D. Johnson, 1009 Julian Pl., Rockville, Md. 20852

[21] Appl. No.: 644,621

[22] Filed: Aug. 27, 1984

[51] Int. Cl.[4] ..... A62C 1/00

[52] U.S. Cl. ..... 169/45; 169/46

[58] Field of Search ..... 169/43, 45, 46, 48, 169/53, 36

[56] References Cited

U.S. PATENT DOCUMENTS 2,576,930 12/1951 Everts ..... 169/46
3,442,334 5/1969 Gousetis ..... 169/53
3,580,339 5/1971 Nance ..... 169/45
3,714,987 2/1973 Mattson ..... 169/53 X
4,285,403 8/1981 Poland ..... 169/36 X

*Primary Examiner*—Andres Kashnikow
*Attorney, Agent, or Firm*—Mills & Coats

[57] ABSTRACT

The present invention entails a system and method of controlling and preventing the spread of land fires and particularly forest fires. This is accomplished by forming a substantial foam strip along an area spaced from the fire, and back burning from the foam strip towards the fire or fire area. To form the foam strip, the present invention discloses the method of dropping foam containing containers from an aircraft in a selected pattern along the strip area designated. The foam containers are provided with valves that open approximately on impact or at a selected time thereafter to cause the release of the foam.

1 Claim, 1 Drawing Figure

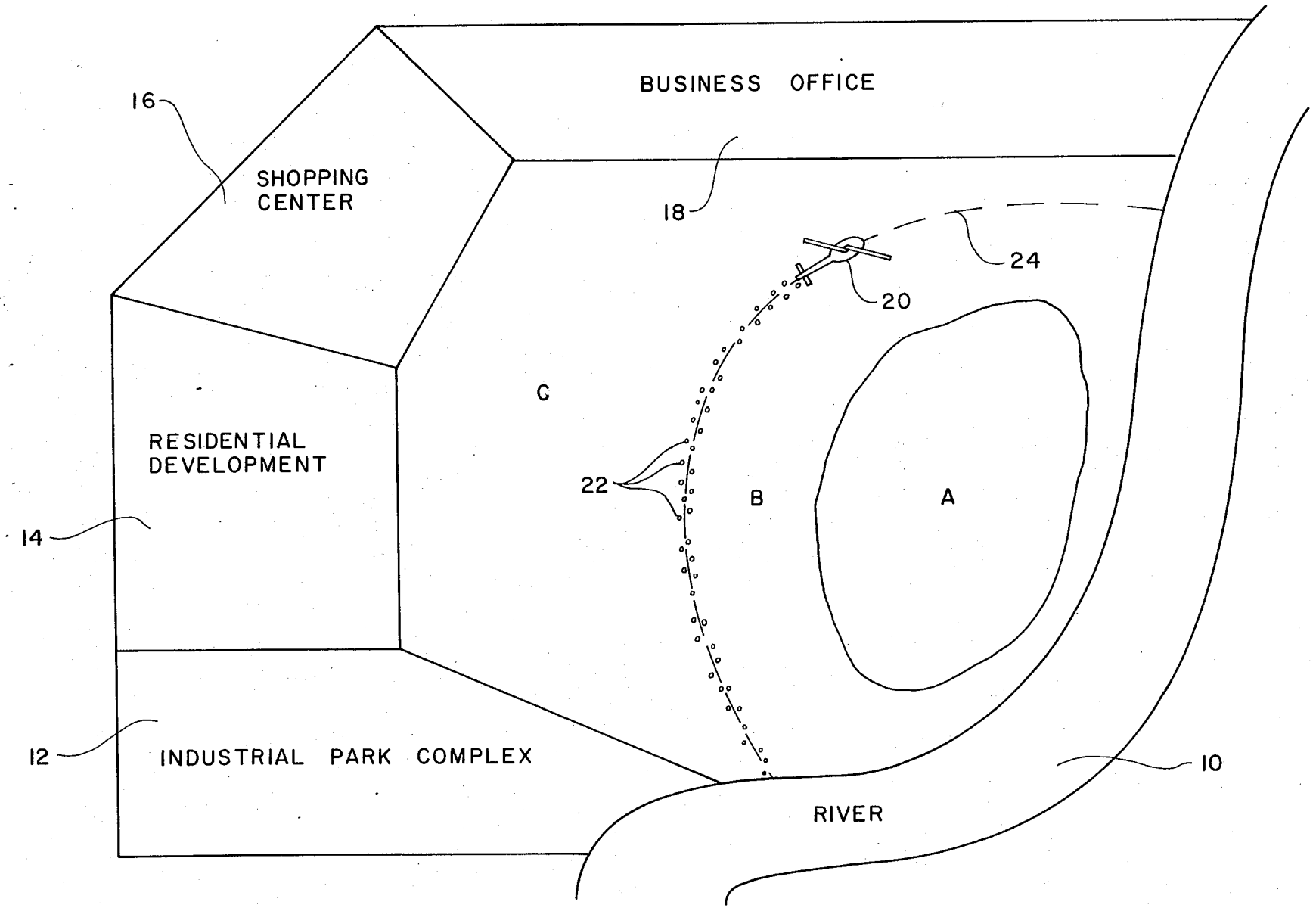
BUSINESS OFFICE
SHOPPING CENTER
RESIDENTIAL DEVELOPMENT
INDUSTRIAL PARK COMPLEX
RIVER
A
B
C
10
12
14
16
18
20
22
24

SYSTEM AND METHOD OF CONTROLLING AND PREVENTING THE SPREAD OF FOREST FIRES

FIELD OF INVENTION

The present invention relates to a system and method for controlling and preventing the spread of land and forest fires and more particularly to a system and method that is at least in part initiated from an aircraft to form a substantial fire barrier at a selected distance from the fire or fire area and then back burning from the fire barrier towards the fire or fire area.

BACKGROUND OF INVENTION

It is almost daily that we learn of a large land or forest fire that rages out of control. These fires sweep through forests, woodlands, residential communities, resulting in tremendous financial losses, not to mention the loss of human lives and the personal losses and trauma suffered by victims of such fires.

No doubt that land and forest fires are a serious problem here in the United States as well as other parts of the world. While we campaign and ask people to be cautious so as to prevent land and forest fires, they still occur and their frequency is hardly diminished. Prevention is important and should be continued to be stressed. But control and preventing the spread of an already existing fire is important also because such fires are going to occur, and accordingly we must learn how to best control such land and forest fires to save lives, reduce personal sufferings and trauma, and to protect our great natural resources and to prevent huge financial losses that are inherent in such fires.

Controlling and preventing the spread of land and forest fires is a difficult and frustrating undertaking. Often the fire is large and this in itself makes the fire harder to control and maintain. In addition where the fire is spread over a substantial area, this causes additional problems inasmuch as the area to protect is relatively large. In certain cases if we add to that dry and/or windy conditions, the problems are multiplied and complicated and the fire is even more difficult to maintain and control.

There are presently accepted methods and techniques for controlling and preventing the spread of land and forest fires. These include the dumping of large amounts of water from aircrafts and also includes attempting to back burn from an area towards the fire so as to effectively remove the intermediate trees and undergrowth, woodland and other material and structure that fuels the fire. Dumping water from aircraft is expensive, time consuming, and often relatively inefficient. This is because, in part at least, one has to have access to water and be able to retrieve the water and make a delivery rather quickly. This cannot always be done, and especially cannot be done very efficiently.

With respect to back burning towards the fire or fire area, this lends itself to special geographical conditions. For example, back burning can be effective where the back burning strip is started adjacent a natural barrier that enables one to control the spread of fire in the opposite direction of where the real fire or fire area exists. Often, however, back burning is not practical nor efficient because of the inability to control and precisely direct the back burning fire.

In summary there is still a great need for new approaches and techniques to fight, control and maintain land and forest fires. There is still the potential to save many lives and to protect vast amounts of natural resources and woodlands.

SUMMARY OF INVENTION

The present invention entails a new system and method for controlling and preventing the spread of land and forest fires. In the present disclosure, there is disclosed a method of controlling and preventing active land or forest fire by forming a continuous strip or boundary of foam along an area spaced from the fire or fire area. After forming the foam strip, the method or process entails back burning from the site of a foam strip facing the fire or fire area towards the fire or fire area. This effectively removes the landscape and foliage between the foam strip and the fire or fire area, thereby controlling the fire and preventing its spread to areas outside of the foam strip.

To lay or set the foam strip, the system and method of the present invention entails providing containers having foam contained therein. These containers are transported to the selected area by aircraft which flies over the selected area and the containers are appropriately dropped from the aircraft along the selected strip area. The containers are designed and controlled so as to emit the foam therefrom at approximately impact or at a selected time thereafter.

It is, therefore, an object of the present invention to provide a system and method of controlling and preventing the spread of land and forest fires by forming a foam strip along an area spaced from the fire or fire area and back burning from the foam strip towards the fire or fire area.

Another object of the present invention resides in the provision of a system and method of controlling and preventing the spread of land and forest fires of the character referred to above wherein the foam strip is applied through the use of aircraft.

Still a further object of the present invention resides in the provision of a system and method of controlling and preventing the spread of forest fires of the character and nature referred to above wherein the same suggests the use of containers to contain the foam, and which suggests the dropping of the foam containing containers by aircraft.

Another object of the present invention resides in the provision of a method and system for controlling and preventing the spread of land and forest fires of the character referred to above, wherein the containers are provided with control valve means for selectively releasing the foam therein at a preselected time such as impact or at a selected time thereafter.

It is also an object of the present invention to provide a system and method for controlling and preventing the spread of land and forest fires by utilizing a foam strip and back burning therefrom towards the fire or fire area wherein the foam strip is substantial and acts as a barrier to fire associated with the back burning such that fire does not move through the foam strip and to the other side thereof such that the direction of back burning can be precisely controlled without a danger and hazard to areas where there is no intention to burn.

Other objects and advantages of the present invention will become from a study of the following description and the accompanying drawings which are merely illustrative of the present invention.

BRIEF DESCRIPTION OF DRAWINGS

The FIGURE is a diagrammatic illustration of the present method invention of controlling and maintaining a forest fire.

SYSTEM AND METHOD FOR CONTROLLING AND PREVENTING THE SPREAD OF A LAND OR FOREST FIRE

With reference to the drawing, there is shown a diagrammatic sketch of a land area. In the drawing it is seen that there is a river running through the area towards an industrial park complex 12. Adjoining the industrial park complex 12 is a residential development 14. Shown adjacent the residential development 14 is a shopping center 16 which in turn joins a business and office complex 18.

To illustrate the system and method of the present invention, assume that the area enclosed and denoted by A represents a fire or fire area. As illustrated in the drawing, the fire area extends along a segment of the river towards the left. The tendency of the fire area A is to move towards the industrial park complex 12, residential development 14, shopping area 16 and business and office complex 18. To the right, as viewed in the drawing, the fire is maintained and controlled by the presence of river 10.

The present invention entails controlling and preventing the spread of the fire in fire area A by providing a foam strip along an area or strip spaced from the fire area A and back burning to the fire area A. Therefore, one first selects the area that would be appropriate for forming the foam strip. In this regard, construction line 24 represents the selected area where the foam line or strip is to be formed. It is noted that line 24 is spaced outwardly from the fire area A a substantial distance so as to form a back burning zone B therebetween. The particular location of the foam line 24 can depend upon various factors, and particularly the environment and geographical conditions surrounding the fire area A. It is important, however, to space the foam line a sufficient distance from the fire area A such that adequate time is provided to back burn a substantial area such that the fire will effectively be prevented from spreading past the foam line 24.

To provide for foam, foam material such as is commercially available today of the basic general nature of shaving cream or other types of foam is packaged and contained within a container. The container is provided with a control valve that allows the foam to be released at a predetermined time and/or in response to the occurrence of a selected event. Details of the container and the valve are not shown herein because such is not per se material to the present invention because containers and valve technology is already known and commercially available to carry forth the desired function.

The foam containing containers are loaded into an aircraft 20, such as an airplane or helicopter, and a sufficient quantity is provided for the length of strip desired. It should be pointed out that it is contemplated that a foam strip three feet wide and three feet deep would generally be sufficient to control and prevent the back burning fire from passing therethrough. The size of the foam strip could, of course, vary to accommodate certain situations. In this regard it is appreciated that the containers could be particularly designed and the density of the drop could be adjusted so as to vary the size of the foam strip to accommodate the particular situation.

To form the foam strip, foam containing containers 22 are dropped from an aircraft as the same flies over the selected foam line 24.

It is contemplated that the containers 22 would be actuated upon impact or shortly thereafter to release the foam. This can be provided by a conventional impact actuated control valve or a time release valve that can be set to open a predetermined time after a selected operation is preferred.

After the foam line 24 has been formed, then zone B illustrated in the drawing is sacrificed by back burning. The back burning step is started at the foam line 24 and consequently as viewed in the drawings the fire tends to move from the foam line 24 towards burning area A and consequently burns through the back burning zone B. This effectively stops, controls and prevents the fire in the fire area A from spreading past the foam line 24. Accordingly, zone C that lies on the opposite side of foam line 24 from the fire area A and is protected and remains protected from fire. Consequently, it is appreciated that in a situation such as illustrated in the drawing, that surrounding homes and businesses are protected. In the case illustrated, the industrial park complex 12, residential development 14, shopping center 16, and business office complex 18 are saved and protected from the fire.

From the foregoing discussion, it is appreciated that the system and method of controlling and preventing the spread of land and forest fires has the potential to save lives, structures, forest, woodlands and other natural resources. The method of the present invention is practical and feasible and has the potential for greatly increasing the effectiveness of the back burning technique and controlling land and forest fires. It is especially effective because it can be carried out by aircraft that enables the entire method to be quickly and efficiently administered.

The present invention, of course, may be carried out in other specific ways than those herein set forth without departing from the spirit and essential characteristics of the invention.

What is claimed is:

1. A method of controlling a land fire such as a forest fire comprising the steps of: forming a foam strip along a land area spaced from an area where fire is present; the step of forming said foam strip including flying an aircraft over the selected area where the foam strip is to be formed, dropping containers containing the foam along the selected area, and actuating said foam containing containers to release the foam upon or after impact of the containers with the ground such that a continuous foam strip is formed along an area spaced from the area where fire is present; and back burning from the foam strip towards the area of fire so as to burn material disposed between the formed foam strip and the area of fire in order to control the movement of fire and to generally prevent the fire from spreading over and beyond the foam strip.

* * * * *